US005514017A

United States Patent [19]

Chimiak

[11] Patent Number: 5,514,017

[45] Date of Patent: May 7, 1996

[54] RECREATIONAL BOARD FOR WATER SPORTS

[76] Inventor: William J. Chimiak, 3803 Tremont Dr., Durham, N.C. 27705

[21] Appl. No.: 277,591

[22] Filed: Jul. 20, 1994

[51] Int. Cl.[6] ..... B63B 35/79

[52] U.S. Cl. ..... 441/65; 114/39.2; 441/74

[58] Field of Search ..... 441/68, 74, 65; 114/39.2, 357

[56] References Cited

U.S. PATENT DOCUMENTS

| | | | |
|---|---|---|---|
| D. 145,083 | 6/1946 | Howland . | |
| D. 174,948 | 6/1955 | Darr | D21/229 |
| D. 193,077 | 6/1962 | Gorman et al. . | |
| D. 194,646 | 2/1963 | Del Mar . | |
| D. 195,384 | 6/1963 | Del Mar . | |
| D. 220,979 | 6/1971 | Belik . | |
| 3,514,798 | 6/1970 | Ellis | 441/74 |
| 3,543,315 | 12/1970 | Hoffman . | |
| 4,330,494 | 5/1982 | Iwata et al. | 264/46.2 |
| 4,379,103 | 4/1983 | Doerfling | 264/45.5 |
| 4,510,105 | 4/1985 | Sherwood | 264/46.6 |
| 4,563,321 | 1/1986 | Gessford | 264/255 |
| 4,664,974 | 5/1987 | Sherwood | 428/309.9 |
| 4,687,691 | 8/1987 | Kay | 428/73 |
| 4,710,432 | 12/1987 | Nishimura | 428/542.8 |
| 4,731,038 | 3/1988 | Hancock et al. | 441/68 |
| 4,753,836 | 6/1988 | Mizell | 428/71 |
| 4,767,369 | 8/1988 | Snyder | 441/68 |
| 4,770,929 | 9/1988 | Nobumasa et al. | 428/284 |
| 4,797,312 | 1/1989 | Sherwood | 428/117 |
| 4,798,549 | 1/1989 | Hirsch | 441/74 |
| 4,897,063 | 1/1990 | Scheurer et al. | 441/68 |
| 5,032,096 | 7/1991 | Scott et al. | 441/74 |
| 5,102,723 | 4/1992 | Pepin | 428/223 |
| 5,182,158 | 1/1993 | Schaeffer | 428/178 |
| 5,266,249 | 11/1993 | Grimes, III et al. | 264/45.2 |

OTHER PUBLICATIONS

Advanced Honeycomb Technologies, Inc. Product Specification Sheet entitled *Kraft Paper Honeycomb . . . Structural Grade . . . AHK* (undated).

Advanced Honeycomb Technologies, Inc. Product Specification Sheet entitled *Aramid (NOMEX) Honeycomb . . . Aerospace Grade . . . AHN 4120* (undated).

Advanced Honeycomb Technologies, Inc. Product Specificatoin Sheet entitled *Aramid (NOMEX) Honeycomb . . . Commercial Grade . . . AHN 7800* (undated).

George Orbelian, *Essential Surfing* (1982), pp. 47, 52–59, 178–191.

*Primary Examiner*—Sherman Basinger

*Attorney, Agent, or Firm*—Bell, Seltzer, Park & Gibson

[57] ABSTRACT

A recreational board for use in water sports is constructed of a lightweight core material and surrounded by a waterproof skin. The core is preferably in a honeycomb orientation and constructed of lightweight fibers such as aramid fibers. The skin contains a first layer of fiberglass scrim and a second laminating layer which saturates the first layer and protects the core from water damage. The board is constructed in a shape that is easily controllable by a rider on the water. The board can also contain one or more fins on the lower surface of the board to provide directional stability to the board. A sail mast can be affixed to the board through its upper surface to allow the board to be wind driven through the water.

10 Claims, 1 Drawing Sheet

RECREATIONAL BOARD FOR WATER SPORTS

FIELD OF THE INVENTION

The present invention relates to recreational boards for water sports. More particularly, the present invention relates to the construction of lightweight and durable surfboards.

BACKGROUND OF THE INVENTION

"Surfing" and related water sports have gained increasing popularity in the United States and around the world, particularly with the advent of windsurfing. Because of the increased interest in surfing, there has been a desire to improve the construction of surfboards to make surfboards lightweight and durable thus providing a rider with a product which is not only longevous but which also maximizes his performance on the water.

Prior to the 1950's, surfboards were typically constructed of lightweight wood and laminated in order to protect the integrity of the wood. In the 1950's, the first fiberglass covered surfboards were constructed thus decreasing the weight and increasing the surfboard's performance. In addition, wooden board cores began to be replaced by even lighter polyurethane foam cores which provided the surfboard with greater longevity. Unfortunately, such foam alone did not possess sufficient material strength to maintain the structural integrity of the board. Foam board cores thus required the addition of wooden stringers to provide web strength to the board. This type of structure limited the number of designs that were sturdy enough for manufacture. In addition, foam surfboards generally did not last more than a year with frequent use. For example, air bubbles tended to form between the fiberglass and the foam thus destroying the structural integrity of the board.

In order to alleviate these problems, other materials have replaced foam in an attempt to increase the structural integrity of the surfboard core. For example, U.S. Pat. No. 4,731,038 to Hancock et al. teaches a water ski constructed with aluminum in a honeycomb orientation. Although the aluminum ski core disclosed in Hancock could theoretically provide a sturdy alternative to traditional foam cores, in surfboards, an aluminum core is heavier than a foam core and thus would very likely hinder the performance of the board. U.S. Pat. No. 3,543,315 to Hoffman discloses a surfboard which uses phenolic impregnated paper in a honeycomb orientation to constitute the core of the surfboard. Nevertheless, in order for such a core to maintain its shape, it must be further fitted on the top and bottom surfaces with aluminum strips. The resulting structure is heavy in relation to the foam boards and does not perform as well.

OBJECT AND SUMMARY OF THE INVENTION

Therefore, it is an object of the present invention to provide a surfboard structure that not only provides structural integrity to the surfboard, but that is lightweight thus maximizing the performance of the board.

The present invention meets this object by providing a recreational board constructed of a honeycomb core and a skin which surrounds the core to provide both structural integrity and buoyancy to the board. In the preferred embodiment, the honeycomb core is constructed of aromatic polyamide fibers; however, kraft paper and carbon fibers can also be used. The skin contains two different components: 1) glass and/or carbon fibers applied to the honeycomb core and 2) a plastic resin, preferably a polyethylene or an epoxy resin, applied to the glass and/or carbon fibers. The glass and/or carbon fibers help to maintain the shape of the core. The plastic resin saturates and surrounds the skin fibers thus providing a smooth surface on the board. In addition, the plastic resin waterproofs the board thus protecting the skin fibers and the honeycomb core from water damage. The board can be further fitted with a fin for greater maneuverability in the water and a sail mast to allow the board to be wind driven through the water.

It is a further object of the present invention to provide a core material which does not require added metal or wooden supports to maintain appropriate strength, and which does not easily break, rip or tear.

It is a still further object of the present invention to provide a skin material which maintains the shape of the core and which produces a board which is smooth, waterproof, and buoyant.

It is a still further object of the present invention to provide a board that can be manufactured in a variety of shapes to fit the specifications or desires of the ultimate user.

These and other objects of the present invention will become more readily apparent upon consideration of the following detailed description and accompanying drawings which describe both the preferred and alternative embodiments of the invention.

DETAILED DESCRIPTION OF THE INVENTION

Figure 1:
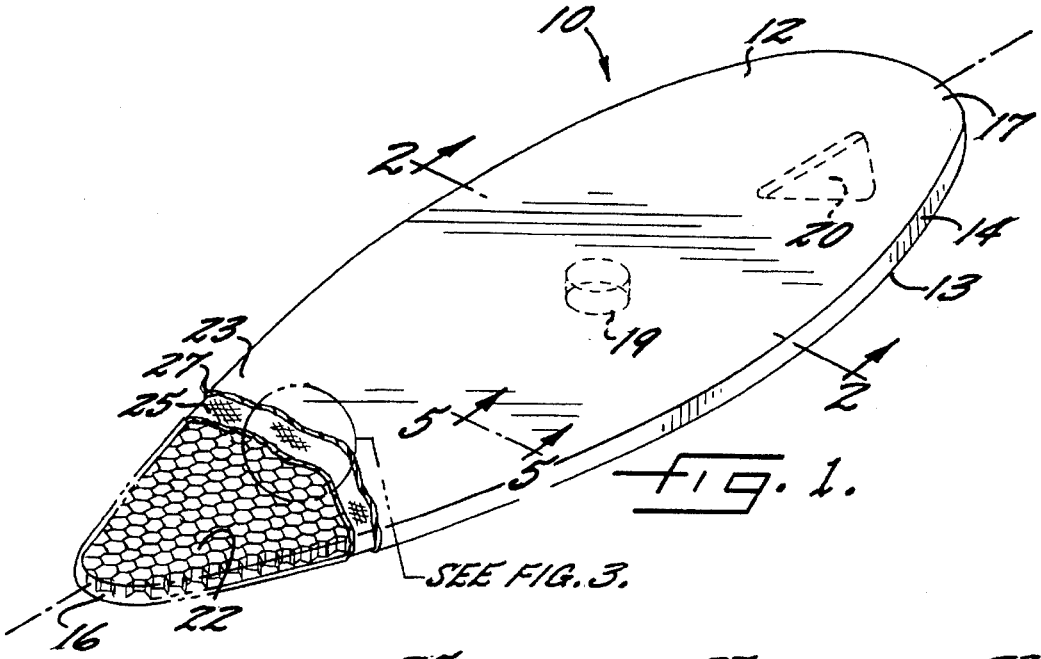
FIG. 1 is a perspective view of a surfboard constructed according to the present invention with a portion of the skin removed to expose the honeycomb core.

FIG. 1 illustrates a recreational board 10 in accordance with the present invention. The board 10 contains an upper surface 12 extending in a longitudinal direction and a lower surface 13 also extending in a longitudinal direction and having substantially the same shape as the upper surface. A thin perimeter 14 extends between the upper surface 12 and lower surface 13. The upper surface 12 is essentially an elliptical shape or any shape which will respond to relevant movement between the board 10 and the water and which supports a rider. An anterior end 16 of the board 10 can be curved as shown in FIG. 1 or converge to a point to allow the board 10 to easily move through the water. A posterior end 17 of the board 10 is generally curved as displayed in FIG. 1 or can converge to a point or to a back edge to allow water to pass freely behind the board.

One or more fins 20 can be affixed to the lower surface 13 of the board 10 to provide greater directional stability to the board and increase the rider's control of the board through water. Typically, the fins 20 are symmetrically placed in relation to a longitudinal axis A running through the center of the board 10 to provide balance to the board when a rider is moving the board through water. Although the structural description of the board 10 generally applies to surfboards, because sail boards are of similar structure, it is foreseeable that those skilled in this art could attach a sail mast (not shown) to the board to allow the board to be wind driven through the water. It is conceivable that such a mast would be affixed to the board 10 through an orifice (shown in dotted lines at 19 in FIG. 1) extending transversely through the upper surface 12 and could be easily attached or removed at the convenience of the user.

Figure 2:
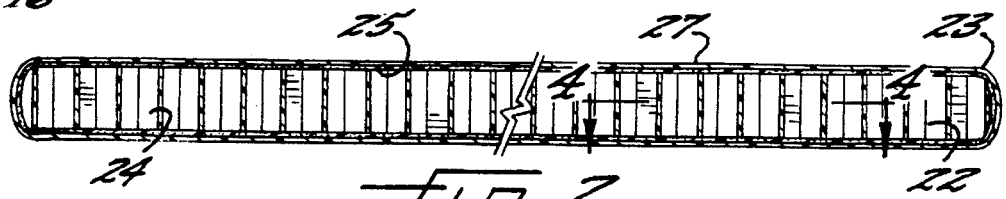
FIG. 2 is a sectional view of the present invention taken along line 2—2 of FIG. 1.

The board 10 is composed of a core 22 and a skin 23. As shown in FIG. 2, the skin 23 completely covers the core 22 thus maintaining air within hexagonal columns 24 in the core and making the board buoyant in water. In addition, the skin 23 prevents water from reaching and damaging the core 22. The skin 23 is thin relative to the core 22 thus allowing the core to substantially entirely provide the structural stability of the board 10. The skin 23 increases the web strength of the board 10 by maintaining the shape of the core 22. In addition, the skin adds tensile strength to the board 10 and dissipates the weight of the rider across the core material thus keeping the board afloat on the water.

The core 22 is constructed of a lightweight yet strong material and configured in a honeycomb orientation. The benefit of the honeycomb orientation is that small amounts of core material can be used thus keeping the core 22 relatively lightweight while still maintaining sufficient strength in the core. For example, a hexagonal orientation of the core material is favored because such an orientation provides great compression strength to the core 22 when a force is applied to the surface of the core. Because the hexagonal orientation is symmetrical and contains no void spaces between hexagonal components, a compression force applied to the core 22 at any point on the surface is distributed across the core structure thus making it difficult to damage the core. Although the honeycomb orientation is preferably in a hexagonal pattern forming hexagonal columns 24 in the core 22, any geometrical pattern which minimizes the amount of material used in the core 22 while still retaining the strength of the core in a transverse direction can be used. Because it is important to select a core material with a high strength to weight ratio, the preferred core material is formed of aromatic polyamide fibers, such as the aramid fiber Kevlar® (lyotropic aromatic polyamide fibers) developed by DuPont. In particular, the Nomex® variety of Kevlar® has proven to be the most advantageous of the Kevlar® fibers developed by DuPont. Other lightweight fibers such as carbon fibers and kraft paper fibers can be used in the same orientation. The kraft paper fibers are coated with a phenolic resin and are more water resistant than the aramid fibers. However, the kraft paper fibers do not possess the material strength of the aramid fibers.

Depending on the size and shape of the board 10, a suitable amount of core material should be used to provide structural integrity to the board. Because of the honeycomb orientation and the strength of the aramid fibers, the core 22 provides sufficient structural integrity to the board 10. Therefore, neither wooden nor metal supports need be provided to strengthen the core structure.

Figure 3:
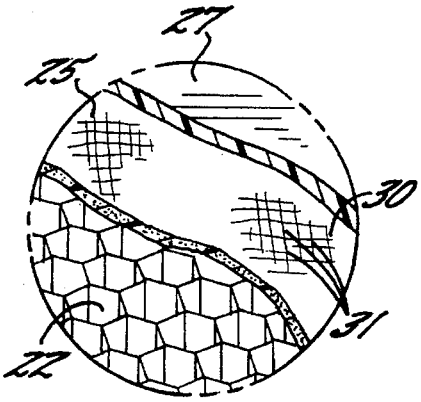
FIG. 3 is a plan view of a cut away portion of FIG. 1 illustrating the orientation and construction of the skin and the honeycomb core.
Figure 4:
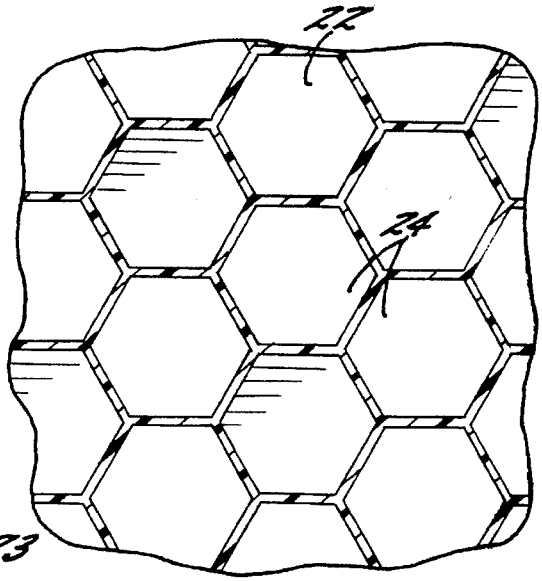
FIG. 4 is a sectional view of the present invention taken along line 4—4 of FIG. 2.

The skin 23 further contains a first layer 25 and a second layer 27. As illustrated in FIG. 3, the first layer 25 surrounds the core 22, provides structural rigidity to the board 10 and maintains the shape of the core. The second layer 27 surrounds the first layer 25 and forms a smooth laminating layer for the board 10. This allows comfort for the rider of the board 10 and decreases the resistance of the board to the flow of water when the board is moving through water. One or more additional laminating layers (not shown) can also be added if desired to the second layer 27.

The first layer 25 contains one or more sublayers of a fiberglass scrim 30 (one such sublayer is shown in FIGS. 1 and 3) which are applied to the core 22. The number of sublayers need not be uniform across the board be and it may be beneficial to apply a greater number of scrim layers at the posterior end 17 of the upper surface 12 to prevent wear to that particular area of the board or to the lower surface 13 around the fin 20 to provide added support in that area of the board. The fiberglass scrim 30 may also be intermixed with carbon fibers to increase the strength of the scrim. In addition, carbon fiber scrim sublayers may be used to further strengthen the skin 23. The fiberglass scrim 30 illustrated in FIG. 3 is a weave of glass fibers, however, the first layer 25 can also be a non-woven scrim of glass fibers.

The second layer 27 is applied to the first layer 25 following the application of the first layer to the core 22. The second layer 27 is generally a laminating resin which is poured on the first layer 29 and saturates the first layer. The laminating resin must be thin enough to fill void spaces 31 within the first layer 25 but should not be so thin as to seep into the hexagonal columns 24 of the core 22. In addition, the second layer 27 must provide a thin, smooth waterproof layer to maximize the rider's comfort and the performance of the board be on water. The conventional resins used on the board 10 are applied with a catalyst such as methyl ethyl ketone peroxide and set at room temperature. It is foreseeable that thermosetting resins can also be used to provide the second layer 27 of the board 10. In a preferred embodiment of the present invention, the second layer 27 is typically either a polyethylene resin or an epoxy resin.

Furthermore, the polymer resin and fiberglass structure provides flange strength by combining the shear strength properties of the resin and the tensile strength of the fiberglass or fiberglass-carbon fiber matrix.

Those of ordinary skill in this art will recognize, however, that a number of other resins can be used which possess the aforementioned properties and which can be selected and applied without undue experimentation. The combination of the core 22 and the skin 23 produce a board which is lightweight and easily maneuvered through water. In addition, the board 10 resulting from this invention is durable and can last for a number of years.

Figure 5:
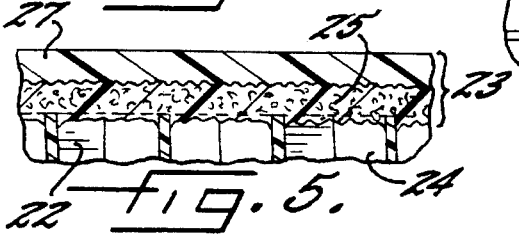
FIG. 5 is a sectional view of the present invention taken along line 5—5 of FIG. 1 and illustrating the relationship of the skin to the core.

FIGS. 2 and 5 further demonstrate the relationship of the core 22 and the skin 23. These drawings reveal that the majority of the core 22 is void space (in the form of hexagonal columns 24) thus allowing the core to be relatively lightweight.

Although the above description generally applies to surfboards, windsurfers, sailboats, water skis, and other boards or board like structures used for water sports, it will be understood that the invention is not limited thereto since modifications may be made by those skilled in the art, particularly in light of the foregoing description. Therefore, said modifications and embodiments are intended to be included within the spirit and scope of the following appended claims.

That which is claimed:

1. A recreational board for water sports such as surfing, said recreational board comprising:

a core that defines an upper surface, a lower surface and a thin perimeter between said upper surface and said lower surface; and a skin entirely covering said core, said skin comprising a scrim of glass fibers applied to said core for providing structural rigidity to said board and maintaining the desired shape of said core, and a lightweight plastic resin applied to and saturating said scrim for preventing water from damaging said core and for providing comfort to a rider moving said board through water;

said core being formed of a honeycomb of an aromatic polyamide, said core entirely filling said skin and providing both structural integrity and buoyancy when said core is covered by said skin, said core having a shape that will respond to relative movement between the shape and the water for permitting said recreational board to float and be controlled by a rider when said board is moving in the water;

wherein the structural stability of said board is substantially entirely provided by said aromatic polyamide core rather than from said skin or from any other reinforcing element.

2. A recreational board according to claim 1 wherein said shape of said core is defined by:

a longitudinally extending upper surface having essentially an elliptical shape;

a longitudinally extending lower surface having substantially the same shape as said upper surface; and a relatively thin perimeter extending between said upper and lower surfaces.

3. The recreational board according to claim 2 wherein said lower surface further comprises a fin affixed to said lower surface for providing directional stability to said board when said board is moving through the water.

4. The recreational board according to claim 2 wherein said board further comprises an orifice extending transversely through said skin and said core for affixing a sail mast therein.

5. The recreational board according to claim 1 wherein said aromatic polyamide core comprises lyotropic aromatic polyamide fibers for providing stability and strength to said core at a relatively light weight so that said board can be easily controlled by a rider when said board is moving in the water.

6. The recreational board according to claim 1 wherein said scrim of glass fibers is woven.

7. The recreational board according to claim 1 wherein said scrim of glass fibers is non-woven.

8. The recreational board according to claim 1 wherein said plastic resin is a polyethylene resin.

9. The recreational board according to claim 1 wherein said plastic resin is an epoxy resin.

10. The recreational board according to claim 1 wherein said skin further comprises carbon fibers interwoven into said scrim of glass fibers for providing added strength to said scrim of glass fibers.

* * * * *

UNITED STATES PATENT AND TRADEMARK OFFICE

CERTIFICATE OF CORRECTION

PATENT NO. : 5,514,017

DATED : May 7, 1996

INVENTOR(S) : Chimiak

It is certified that error appears in the above-identified patent and that said Letters Patent is hereby corrected as shown below:

Column 2, line 67, "A" should be --A--.

Column 4, line 7, "be" (second occurrence) should be --10--.

Column 4, line 26, "be" should be --10--.

Signed and Sealed this

Twenty-fifth Day of March, 1997

*Attest:*

*Attesting Officer*

Bruce Lehman

BRUCE LEHMAN

*Commissioner of Patents and Trademarks*